US008109576B2

(12) United States Patent
Lin

(10) Patent No.: US 8,109,576 B2
(45) Date of Patent: Feb. 7, 2012

(54) SEAT ASSEMBLY

(75) Inventor: Cheng-Hung Lin, Jhongpu Hsiang (TW)

(73) Assignee: Uei Yuang Enterprise Co., Ltd., Chia-Yi County (TW)

( * ) Notice: Subject to any disclaimer, the term of this patent is extended or adjusted under 35 U.S.C. 154(b) by 123 days.

(21) Appl. No.: 12/656,286

(22) Filed: Jan. 25, 2010

(65) Prior Publication Data

US 2011/0181092 A1 Jul. 28, 2011

(51) Int. Cl.
*A47C 7/02* (2006.01)
*A47C 7/22* (2006.01)

(52) U.S. Cl. ..... 297/452.56; 297/452.13; 297/452.63; 297/452.64

(58) Field of Classification Search ..... 297/452.13, 297/452.56, 452.63, 452.64
See application file for complete search history.

(56) References Cited

U.S. PATENT DOCUMENTS

| | | | | |
|---|---|---|---|---|
| 3,041,109 | A * | 6/1962 | Eames et al. | 297/452.13 X |
| 3,088,517 | A * | 5/1963 | Schwartz et al. | 297/452.63 X |
| 3,175,269 | A * | 3/1965 | Raduns et al. | 297/452.63 X |
| 3,300,251 | A * | 1/1967 | Helms | 297/451.4 |
| 3,844,612 | A * | 10/1974 | Borggren et al. | 297/451.3 |
| 6,540,950 | B1 * | 4/2003 | Coffield | 297/452.64 X |
| 6,899,398 | B2 * | 5/2005 | Coffield | 297/452.56 |
| 6,942,300 | B2 * | 9/2005 | Numa et al. | 297/452.56 |
| 7,040,834 | B2 * | 5/2006 | Nardi | 297/452.13 X |
| 7,152,929 | B2 * | 12/2006 | Wu | 297/452.56 |
| 7,425,039 | B2 * | 9/2008 | Lin | 297/452.56 |
| 8,029,066 | B2 * | 10/2011 | Su | 297/452.56 X |
| 2007/0170756 | A1 * | 7/2007 | Kang | 297/452.56 X |
| 2011/0025109 | A1 * | 2/2011 | Ryczek et al. | 297/217.3 X |

FOREIGN PATENT DOCUMENTS

EP 210710 A2 * 2/1987

* cited by examiner

*Primary Examiner* — Rodney B White
(74) *Attorney, Agent, or Firm* — Rosenberg, Klein & Lee

(57) ABSTRACT

A seat assembly is revealed. A connection slot is formed around a circumference of a rear side of a support and an assembly block is projectingly arranged at a center of the connection slot. At least one channel penetrating from one side to the other side of the assembly block is formed on the assembly block. A cloth surface is covered from a front side to a rear side of the support and a circumference thereof is mounted into the connection slot. A frame formed by injection molding is to cover the circumference of the rear side of the support and fill into the connection slot and the channel so as to connect and secure the cloth surface with the frame as well as the support by multiple bends of the cloth surface and infiltration of frame material into pores of the cloth surface.

3 Claims, 10 Drawing Sheets

SEAT ASSEMBLY

BACKGROUND OF THE INVENTION

1. Fields of the Invention

The present invention relates to a seat assembly, especially to a seat assembly in which a circumference of a cloth surface is bent several times and injected material for a frame infiltrates into pores of the cloth surface completely so as to integrate and connect the circumference of the cloth surface with the frame as well as the support tightly.

2. Descriptions of Related Art

While sitting on a seat, the seat provides people with greater comfort. Chairs with various designs are with different functions such as supporting, blocking up or leaning. A general seat consists of a seat cushion, a seat back and a headrest respectively providing user's bottom, back and head support. The seat cushion, the seat back and the headrest all includes a support, a cloth surface and a frame that connects the cloth surface with the support.

Refer to FIG. 10, a general seat assembly available now includes a support 5, a cloth surface 6 and a frame 7. A joining slot 51 is formed on the support 5 and a joining block 71 corresponding to and mounted into the joining slot 51 is formed on the frame 7. Thereby an edge of the cloth surface 6 folded and mounted into the joining slot 51 is pressed and fixed between the support 5 and the frame 7.

However, when a person sits on the seat, most of his weight is distributed over the cloth surface 6. After prolonged use, the edge of the cloth surface 6 fixed between the support 5 and the frame 7 begin to wear and slip and finally break along a connection area between the joining slot 51 of the support 5 and the joining block 71 of the frame 7. The seat is damaged.

Thus there is a need to provide a new design of the seat assembly formed by the support 5, the frame 7 and the cloth surface 6 connected with one another. The novel seat assembly can overcome shortcomings of conventional seat assembly in which slipping and detaching of the cloth surface 6 occur after the edge of the cloth surface 6 receiving user's weight on the seat for a long period.

SUMMARY OF THE INVENTION

Therefore it is a primary object of the present invention to provide a seat assembly in which a circumference of a cloth surface is connected and integrated with a frame and with a support firmly.

In order to achieve above object, a seat assembly according to the present invention includes a support, a cloth surface and a frame.

The support includes a connection slot formed around a circumference of a rear side thereof, an assembly block projectingly arranged at a center of the connection slot, and at least one channel penetrating from one side to the other side of the assembly block. The connection slot is divided into an outer connection slot and an inner connection slot by the assembly block.

The cloth surface covers the support from a front side of the support to a rear side of the support. A circumference of the cloth surface is mounted in the outer connection slot, located on one side of the assembly block 12, and then passing through the channel on the assembly block and bending to the other side of the assembly block to be attached to the other side of the assembly block that faces the inner connection slot.

The frame is formed by injection molding and is covering the circumference of the rear side of the support. The frame is filled into the connection slot of the support and the channel of the assembly block so as to integrate with the support and the circumference of the cloth surface that passes through both the connection slot and the channel of the assembly block.

Thereby the circumference of the cloth surface is bent several times and the injected material for the frame infiltrates into pores of the cloth surface completely. Thus the circumference of the cloth surface is connected and integrated with the frame as well as the support firmly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
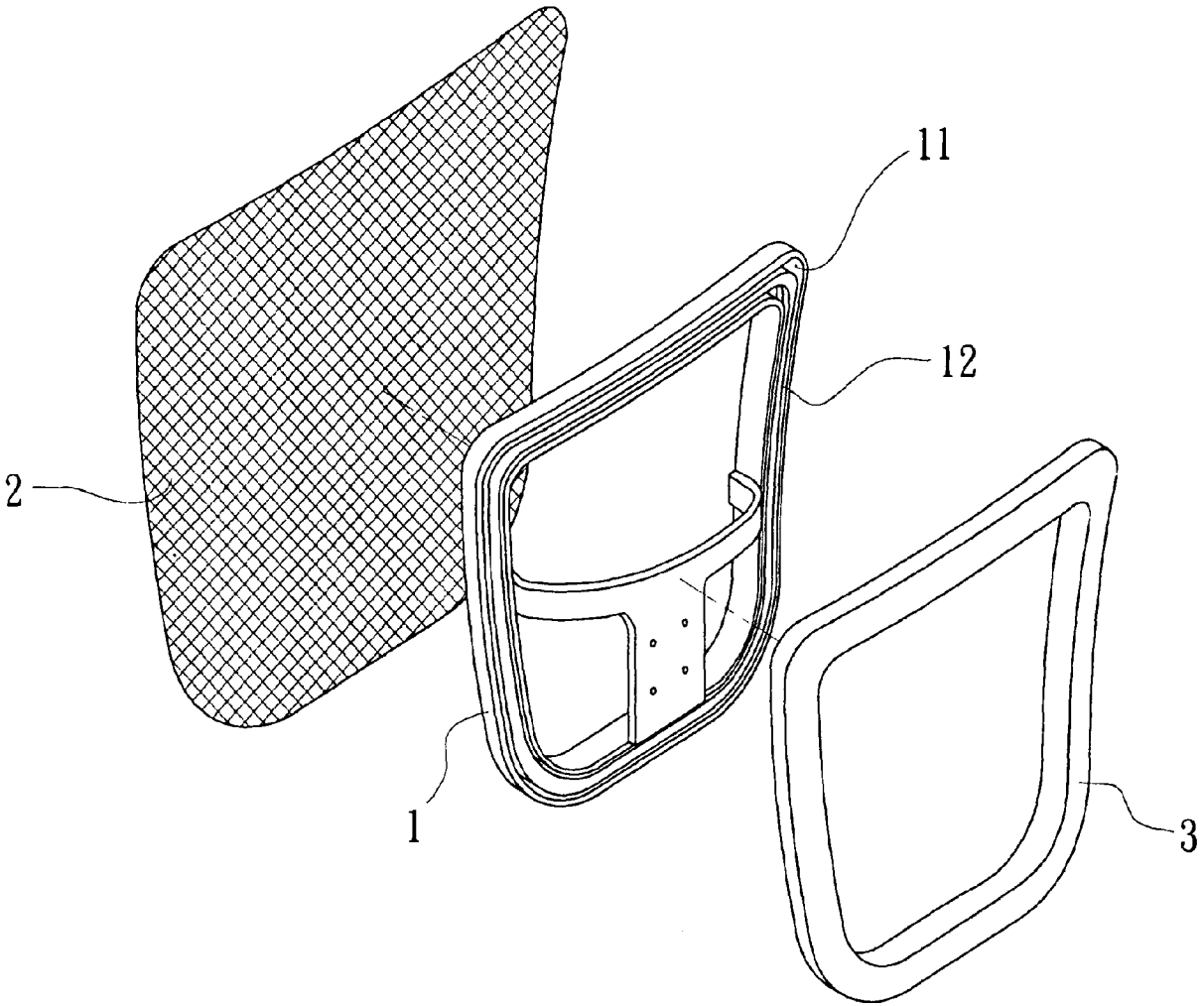
FIG. 1 is an explosive view of an embodiment according to the present invention.
Figure 2:
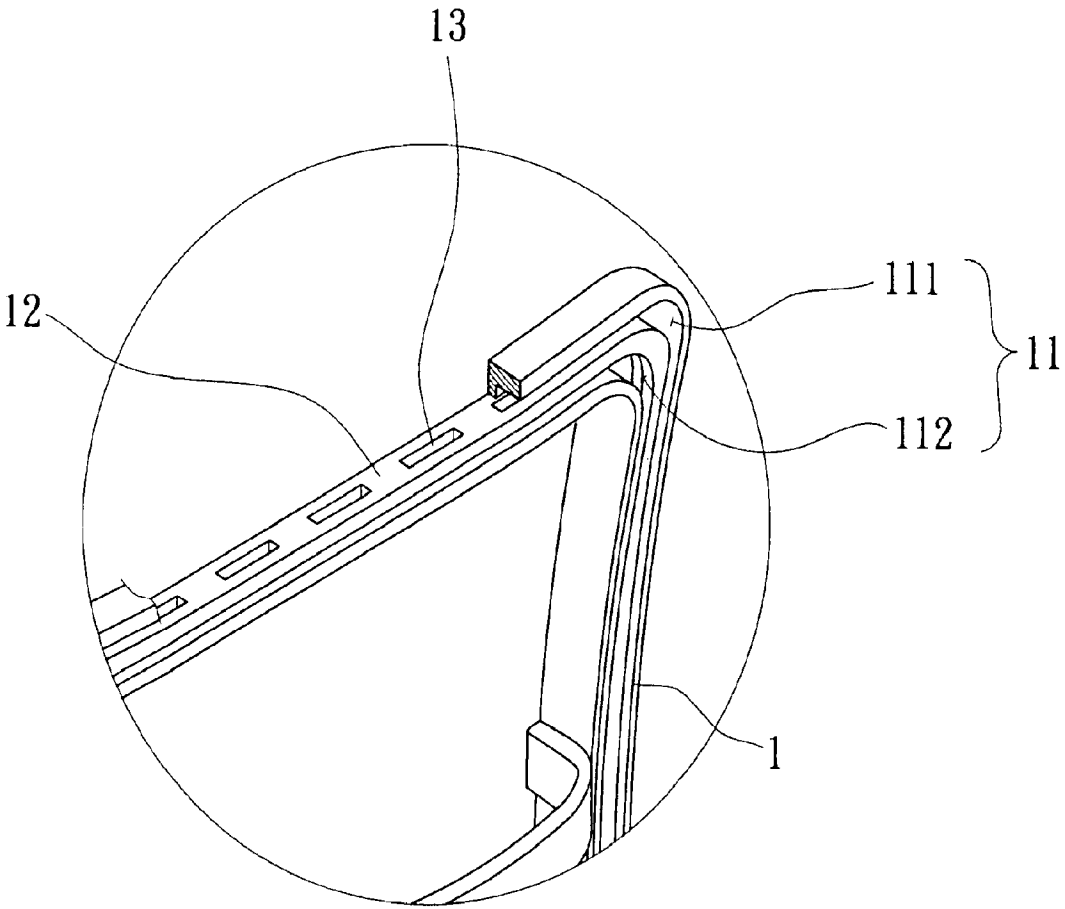
FIG. 2 is a partial enlarged view of an embodiment according to the present invention.

Refer to FIG. 1 and FIG. 2, a seat assembly of the present invention includes a support 1, a cloth surface 2 and a frame 3.

Figure 8:
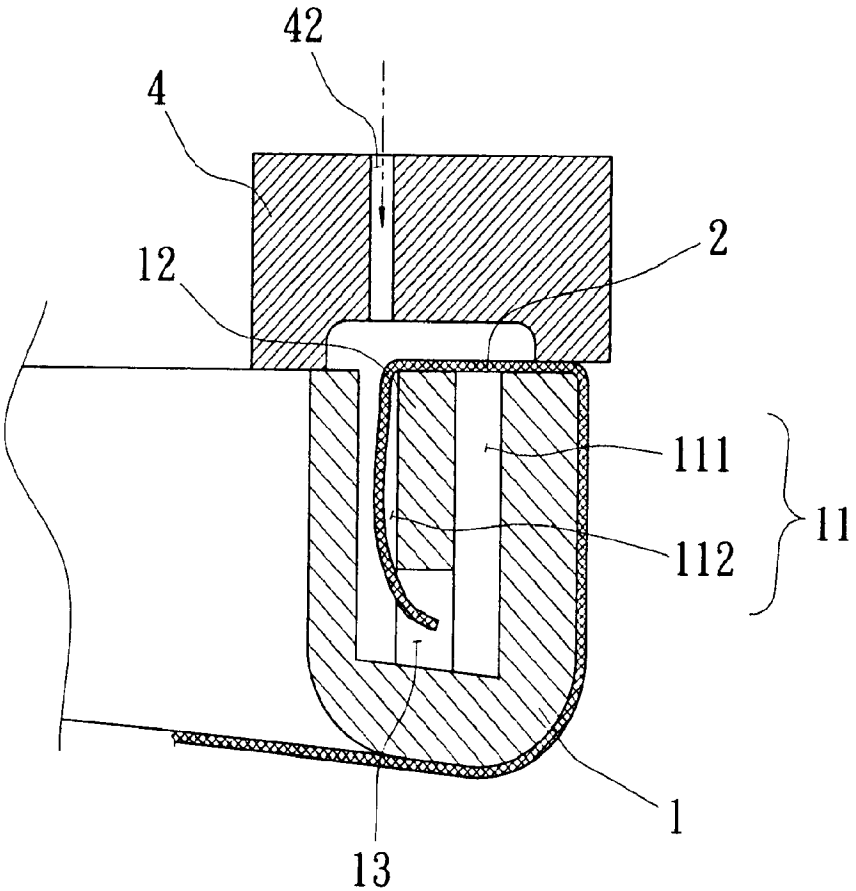
FIG. 8 is a schematic drawing showing filling of frame material of another embodiment according to the present invention.

The support 1 consists of a connection slot 11 formed around a circumference of a rear side thereof, an assembly block 12 projectingly arranged at a center of the connection slot 11, and at least one channel 13 that penetrates from one side to the other side of the assembly block 12. Moreover, the connection slot 11 is divided into an outer connection slot 111 and an inner connection slot 112 by the assembly block 12. A mold 4 for forming the frame 3 is disposed with a first injection point 41 and a second injection point 42 respectively corresponding to the outer connection slot 111 and the inner connection slot 112, as shown in FIG. 3 and FIG. 8.

Figure 3:
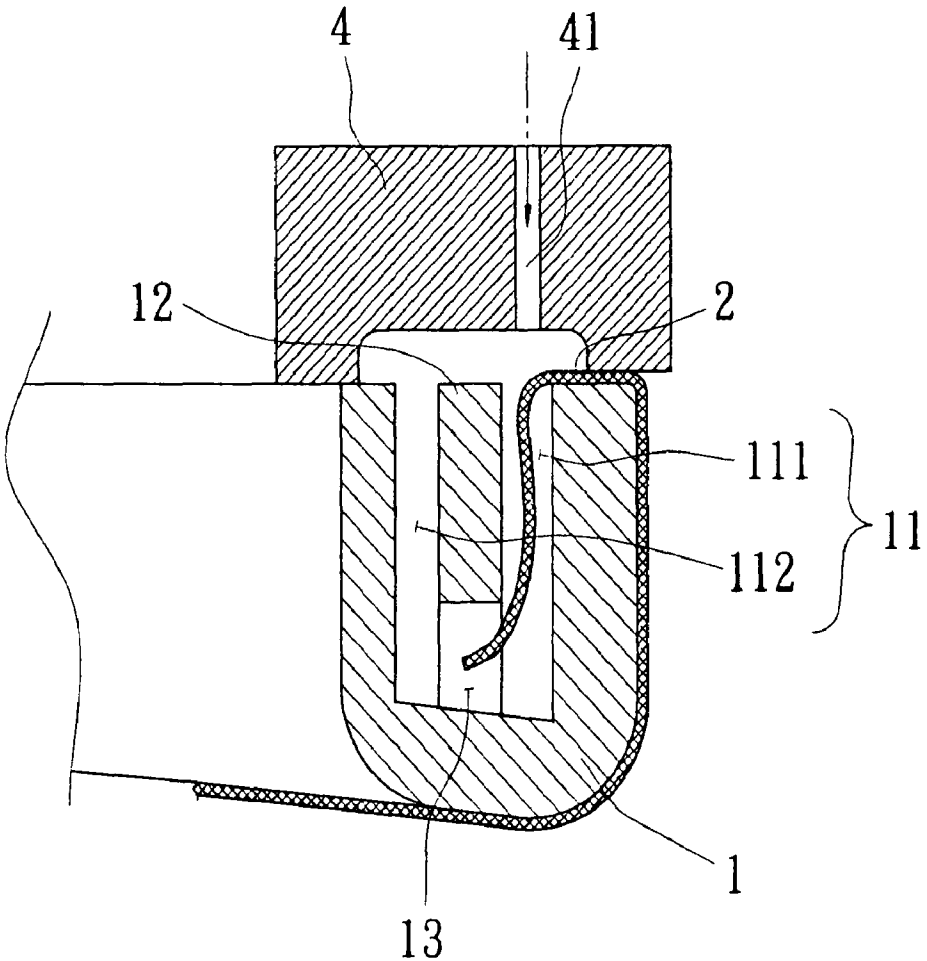
FIG. 3 is a schematic drawing showing filling of frame material of an embodiment according to the present invention.
Figure 4:
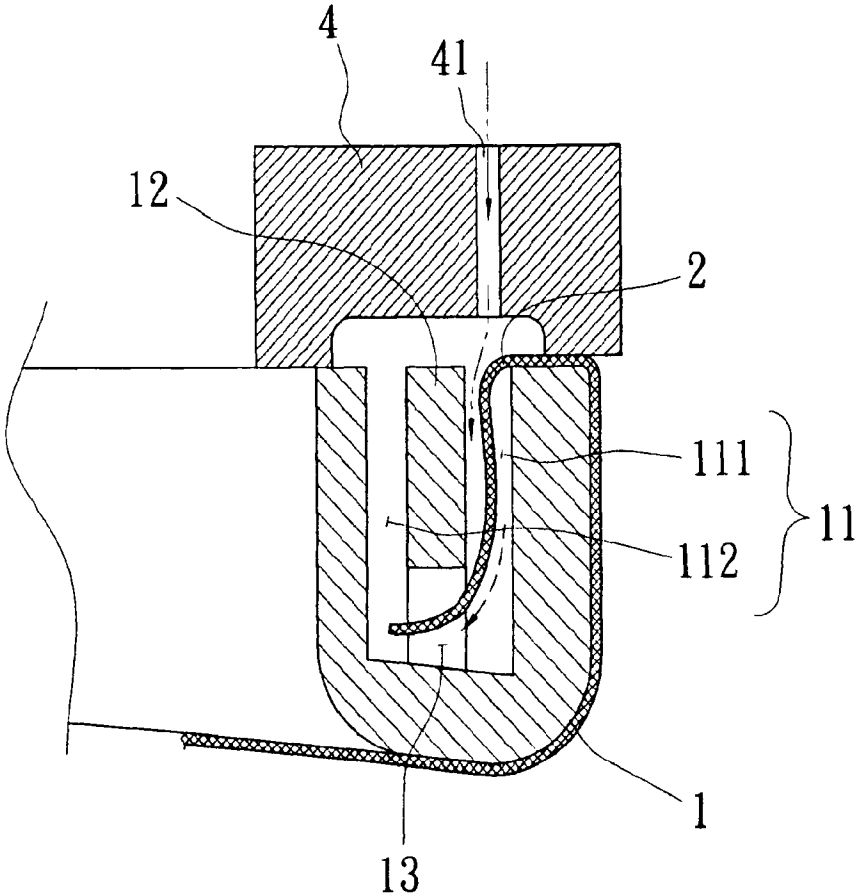
FIG. 4 is a schematic drawing showing filling of frame material of an embodiment according to the present invention.

Refer to FIG. 3 and FIG. 4, the cloth surface 2 covers the support 1 from the front side of the support 1 to the rear side thereof. A circumference of the cloth surface 2 is mounted into the outer connection slot 111, extending from one side of the assembly block 12, passing through the channel 13 on the assembly block 12 and bending to the other side of the assembly block 12 to be attached to the other side of the assembly block 12 that is in the inner connection slot 112.

Figure 5:
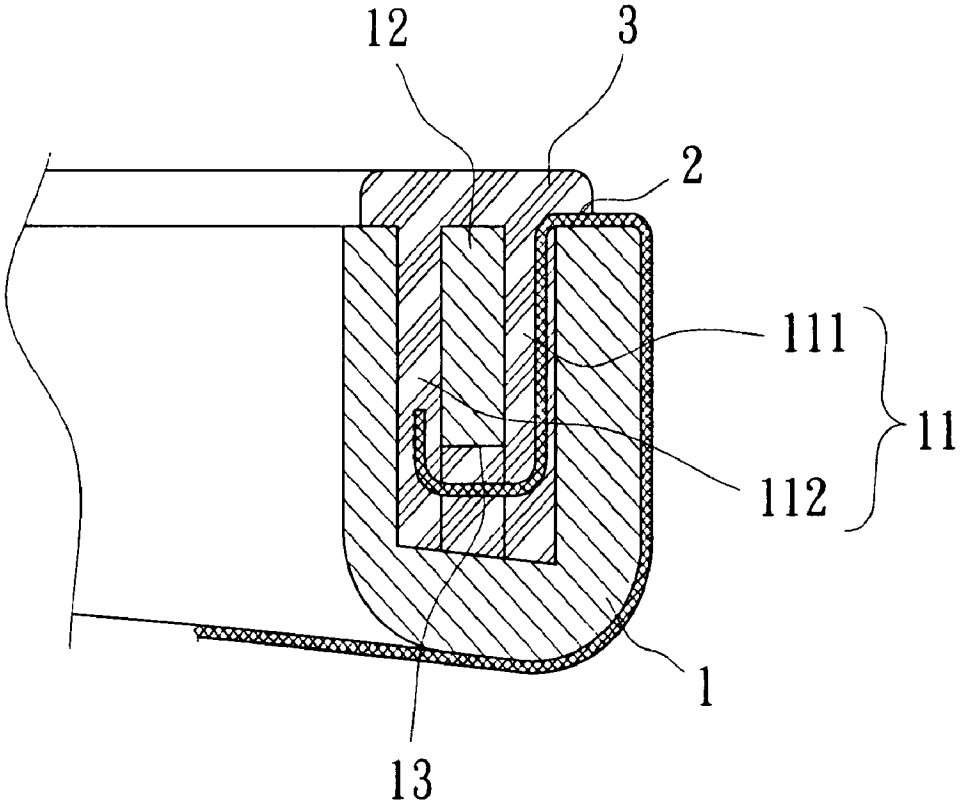
FIG. 5 is a schematic drawing showing filling of frame material of an embodiment according to the present invention.

As shown in FIG. 5, the frame 3 formed by injection molding covers the circumference of the rear side of the support 1. The frame 3 is filled into the connection slot 11 of the support 1 and the channel 13 of the assembly block 12 so as to integrate with the support 1 and the circumference of the cloth surface 2 that passes through both the connection slot 11 and the channel 13 of the assembly block 12.

Back to FIG. 3, during manufacturing processes, the cloth surface 2 is pulled and covered from the front side of the support 1 to the rear side of the support 1 so that the circumference of the cloth surface 2 is mounted into the outer connection slot 111 on the rear side of the support 1.

Then the mold 4 for forming the frame 3 is set on the rear side of the support 1 and is pressed against the cloth surface 2 pulled and covered on the rear side of the support 1 so as to fix the cloth surface 2. Refer to FIG. 4 and FIG. 5, next liquid material for the frame 3 is filled into the outer connection slot 111 of the support 1 through the first injection point 41 that is corresponding to the outer connection slot 111 of the support 1. By the flowing and driving of the liquid material for the frame 3, the circumference of the cloth surface 2 inside the outer connection slot 111 of the support 1 is extending from one side of the assembly block 12 of the support 1, through the channel 13 of the assembly block 12 and to the other side of the assembly block 12 facing the inner connection slot 112. Thus the circumference of the cloth surface 2 is connected and integrated with the frame 3 and the support 1 firmly.

Figure 6:
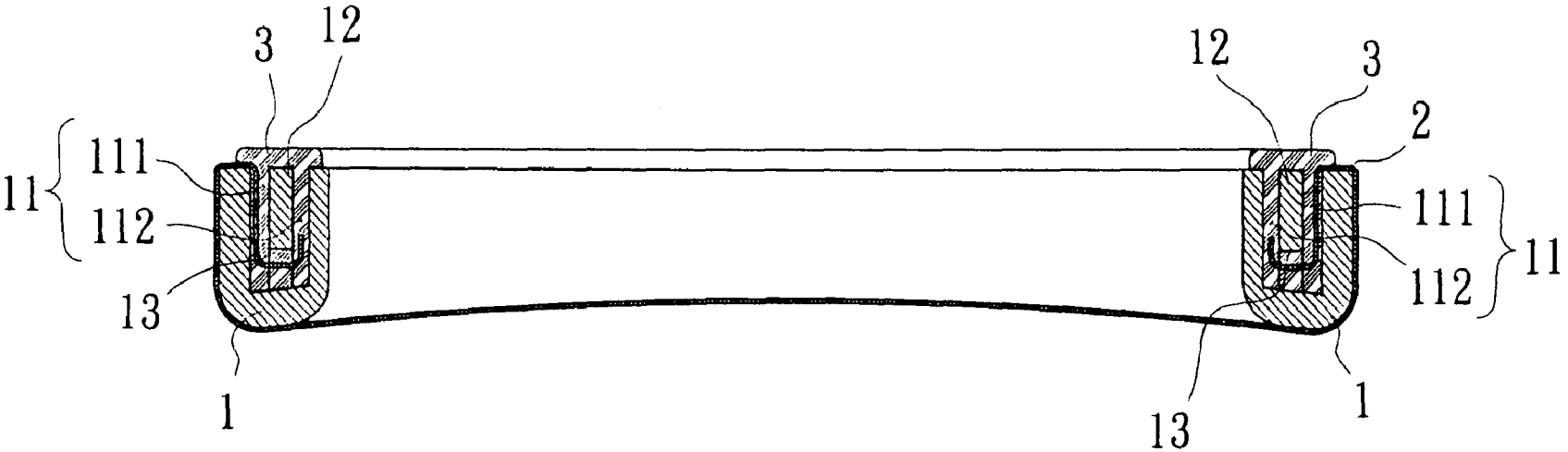
FIG. 6 is a front cross sectional view of an embodiment according to the present invention.
Figure 7:
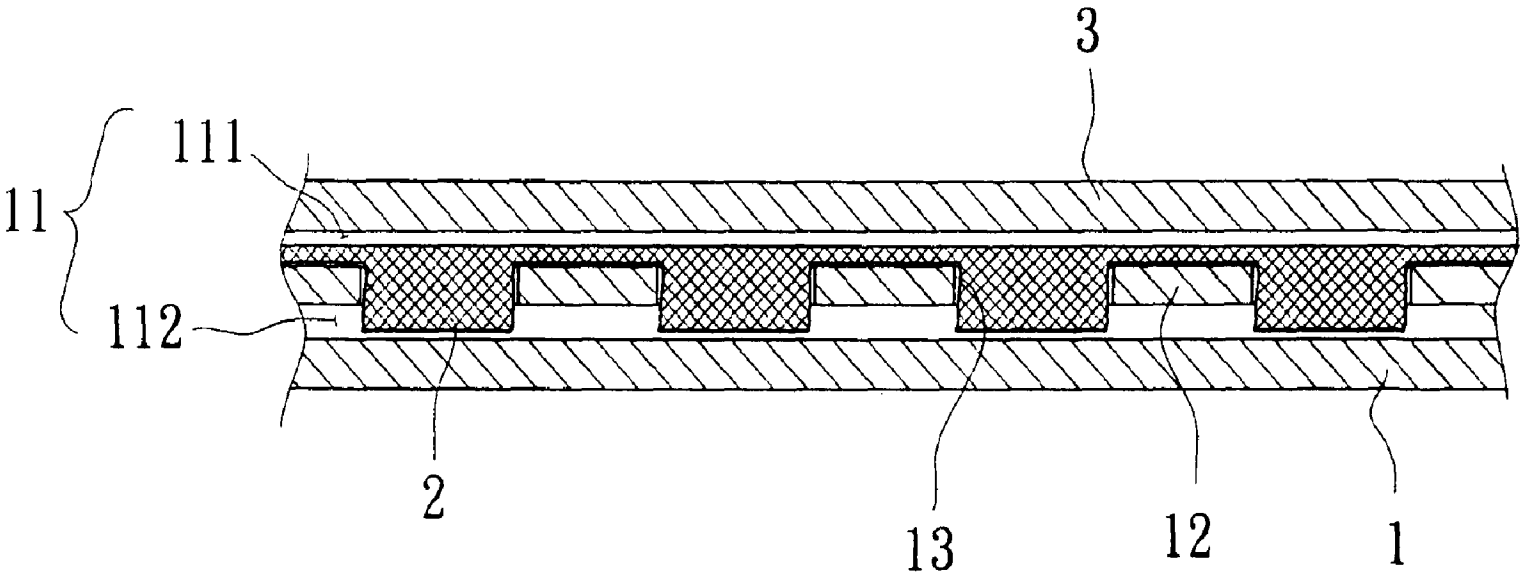
FIG. 7 is a top cross sectional view of an embodiment according to the present invention.

Refer to FIG. 6 and FIG. 7, along with the filling of the liquid material for the frame 3 into the connection slot 11 of the support 1, the circumference of the cloth surface 2 also is flowing with the liquid material for the frame 3, moved to against one side of the assembly block 12, passing through the channel 13 of the assembly block 12 and flowing to attach to the other side of the assembly block 12. During these processes, the liquid material for the frame 3 infiltrates into pores of the cloth surface 2 completely so as to connect with the cloth surface 2 firmly. Furthermore, the circumference of the cloth surface 2 flows with the liquid material for the frame 3 and bends several times along two sides of the assembly block 12 and the channel 13 so that bonding strength between the circumference of the cloth surface 2 and the support is improved effectively.

Thereby by the integrated connection between the circumference of the cloth surface 2 and the frame 3 as well as the integrated connection between the circumference of the cloth surface 2 and the support 1, the connection fastness of the cloth surface 2 with the frame 3 and the support 1 is increased dramatically. The cloth surface 2 still has been fastened tightly with the frame 3 as well as with the support 1 without slipping and detaching even after receiving a load of user's weight for a long period.

Figure 9:
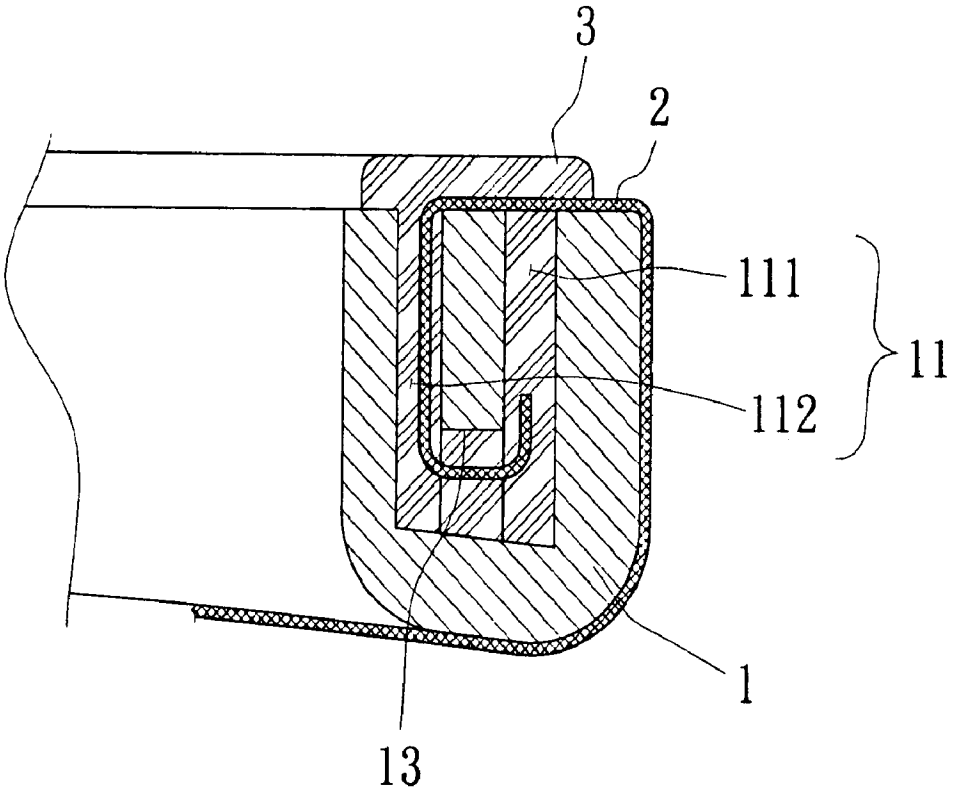
FIG. 9 is a schematic drawing showing filling of frame material of another embodiment according to the present invention.
Figure 10:
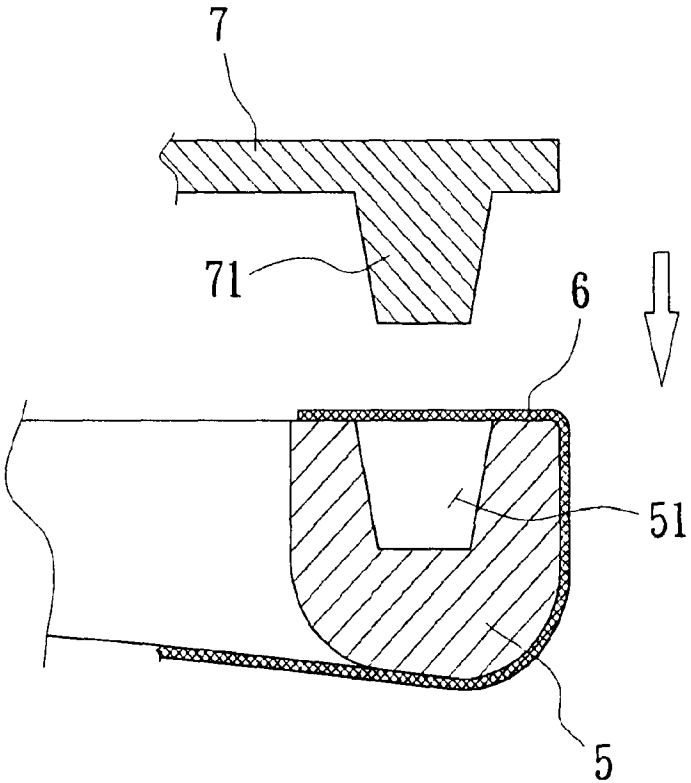
FIG. 10 (PRIOR ART)
FIG. 10 is a schematic drawing showing an assembly state of a seat assembly available now.

Refer to FIG. 8 and FIG. 9, another embodiment of the present invention is revealed. The circumference of the cloth surface 2 is pulled over a top of the assembly block 12 of the support 1, bent, inserted into the inner connection slot 112 and then is moved along one side of the assembly block 12. Then the mold 4 for forming the frame 3 is installed on the rear side of the support 1 and is pressed against the cloth surface 2 pulled to the rear side of the support 1 so as to fix the cloth surface 2. The mold is disposed with a second injection point 42 that is corresponding to the inner connection slot 112 of the support 1. Next liquid material for the frame 3 is filled into the inner connection slot 112 of the support 1 through the second injection point 42 of the mold 4. Thereby when the liquid material for the frame 3 is filled through the second injection point 42 into the inner connection slot 112 of the support 1, the liquid material for the frame 3 pulls the circumference of the cloth surface 2 from the inner connection slot 112, through the channel 13 of the assembly block 12, to the outer connection slot 111 and attach to the other side of the assembly block 12. Moreover, the liquid material for the frame 3 fills the outer connection slot 111 as well as the inner connection slot 112 and covers the whole assembly block 12. Thus the circumference of the cloth surface 2 is integrated and secured with the frame 3 and, the support 1 more firmly.

In summary, the seat assembly of the present invention has following advantages:

1. The circumference of the cloth surface is bent and mounted into the connection slot of the support and then liquid material for the frame is filled into the connection slot of the support so as to make the circumference of the cloth surface move along with the liquid material for the frame, from one side of the connection slot, through the channel of the assembly bloc, to the other side of the connection slot. Thus the cloth surface is connected and integrated with the frame as well as the support firmly by multiple bends of the circumference of the cloth surface and infiltration of liquid material for the frame into pores of the cloth surface.

2. According to different positions of the injection point of the liquid material for the frame, the circumference of the cloth surface is pulled to different positions in the connection slot of the support. When the material is filled through the connection slot at a lower position, the circumference of the cloth surface is pulled over a top of the assembly block to be mounted into the connection slot at the lower position. Then along with the liquid material for the frame, the circumference of the cloth surface passing through the channel of the assembly block is driven to the connection slot at an upper position. Through this process, the circumference of the cloth surface is bent one more time and connection strength between the cloth surface and the frame as well as the support is increased.

Additional advantages and modifications will readily occur to those skilled in the art. Therefore, the invention in its broader aspects is not limited to the specific details, and representative devices shown and described herein. Accordingly; various modifications may be made without departing from the spirit or scope of the general inventive concept as defined by the appended claims and their equivalents.

What is claimed is:

1. A seat assembling comprising:

a support having a connection slot formed around a circumference thereof, an assembly block projectingly arranged at a center of the connection slot, and at least one channel penetrating from one side to the other side of the assembly block;

a cloth surface that covers the support from a front side of the support to a rear side of the support and a circumference of the cloth being mounted in the connection slot, and a frame formed by injection molding, covering the circumference of the rear side of the support and being filled into the connection slot of the support and the channel of the assembly block so as to draw the cloth surface passing through the connection slot and into the channel of the assembly block to be integrated with the support and the circumference of the cloth;

wherein the connection slot is divided into an outer connection slot and an inner connection slot by the assembly block; the circumference of the cloth passes from the outer connection slot, through the channel of the assembly block into the inner connection slot.

2. The device as claimed in claim 1, wherein the connection slot is divided into an outer connection slot and an inner connection slot by the assembly block; the circumference of the cloth passes through the outer connection slot, over a top of the assembly block to be mounted into the inner connection slot and then from the inner connection slot, through the channel of the assembly block into the outer connection slot.

3. A seat assembling comprising:

a support having a connection slot formed around a circumference thereof, an assembly block projectingly arranged at a center of the connection slot, and at least one channel penetrating from one side to the other side of the assembly block;

a cloth surface that covers the support from a front side of the support to a rear side of the support and a circumference of the cloth being mounted in the connection slot, and a frame formed by injection molding, covering the circumference of the rear side of the support and being filled into the connection slot of the support and the channel of the assembly block so as to draw the cloth surface passing through the connection slot and into the channel of the assembly block to be integrated with the support and the circumference of the cloth wherein the connection slot is divided into an outer connection slot and an inner connection slot by the assembly block; the circumference of the cloth passes through the outer connection slot, over a top of the assembly block to be mounted into the inner connection slot and then from the inner connection slot, through the channel of the assembly block into the outer connection slot.

* * * * *